United States Patent [19]

Simon

[11] Patent Number: 4,989,584

[45] Date of Patent: Feb. 5, 1991

[54] PORTABLE MASSAGING LEG REST

[75] Inventor: Gerald L. Simon, Sherman Oaks, Calif.

[73] Assignee: Jereva, Inc., Sherman Oaks, Calif.

[21] Appl. No.: 319,174

[22] Filed: Mar. 2, 1989

[51] Int. Cl.[5] ..... A61H 1/00

[52] U.S. Cl. ..... 128/33; 128/34; 128/35; 128/36

[58] Field of Search ..... 128/33, 34, 35, 36, 128/57, 64

[56] References Cited

U.S. PATENT DOCUMENTS

| | | | |
|---|---|---|---|
| 2,562,769 | 7/1951 | Busse | 128/36 |
| 2,771,875 | 11/1956 | Cason | 128/33 |
| 2,902,993 | 9/1959 | Wagner | 128/36 |
| 2,951,479 | 9/1960 | Sellner | 128/33 |
| 3,464,405 | 9/1969 | Skallus | 128/33 |
| 3,640,272 | 2/1972 | Hussey | 128/33 |
| 3,732,860 | 5/1973 | Thurmer | 128/33 |
| 3,854,474 | 12/1974 | Carruth | 178/33 |
| 4,326,506 | 4/1982 | Kawabata | 128/33 |
| 4,607,624 | 8/1986 | Jefferson | 128/33 |

*Primary Examiner*—Edgar S. Burr
*Assistant Examiner*—Lisa E. Malvaso
*Attorney, Agent, or Firm*—Christie, Parker & Hale

[57] ABSTRACT

A portable massaging leg rest comprises a generally polygonal body of resilient foam having a top face and a front face sloping away from the top face with a sharp angle between the top and sloping faces. The upper portion of the body is formed of a cushioning resilient foam which is softer than foam in the lower portion of the body. An eccentric motor is mounted on a rigid plate within the body for causing massaging motion in at least the top poriton of the body. A channel extends through the body to the motor through which air can circulate for cooling the motor.

23 Claims, 2 Drawing Sheets

PORTABLE MASSAGING LEG REST

BACKGROUND OF THE INVENTION

It has long been recognized that the fatigue and lower leg discomfort associated with prolonged periods of standing upright, as well as the diminished blood circulation experienced by persons leading a sedentary lifestyle, can be alleviated by elevating one's legs and feet above the heart. Propping one's feet up results in drainage of pooled blood from veins in the feet, ankles and calves, and results in improved circulation. Leg elevation also relieves cramping of the calf muscles and may be useful for persons subject to fluid accumulation and for pregnant women.

Muscular massaging techniques are known to provide therapeutic benefits to tired, cramped muscles. Both mechanical and electrical devices have been used to provide vibrational stimulation of most of the muscle groups of the human body.

Attempts to achieve the benefits of both leg elevation and muscular massage are known, and were heretofore primarily embodied in the electric bed. The electric bed essentially combines a flexible mattress with an electrically powered folding frame which can be adjusted to various configurations. In one configuration, a person's legs and feet may be elevated above the heart. Additionally, some of such beds have vibrational means disposed therein.

Electric beds suffer from several therapeutic, economic, and practical limitations. First, they are expensive and bulky, requiring the purchase of an entire bed to realize the advantages of muscle message and leg elevation. Second, adequate thigh support is not provided due to the constraints imposed by the mattress. Instead of folding at a sharp angle beneath the knees, the mattress is essentially rounded and does not properly support the legs. Third, typically the entire bed vibrates when the electric bed vibration is used. They are, of course, limited to a single location and may not be taken along when travelling, for example.

SUMMARY OF THE INVENTION

The present invention overcomes the limitations of the electric bed and provides a convenient, effective, low cost device for alleviating muscular fatigue and discomfort in the legs and lower back. Accordingly, the portable massaging leg rest comprises a resilient, generally trapezoidal body for supporting a person's legs, means for vibrating at least the upper portion of the body for massaging a person's legs, and means for housing the vibrating means within the body.

More specifically, the invention comprises a generally trapezoidal leg rest constructed from at least two sections of material. A base section is provided with a compartment extending therethrough, which allows access to an eccentric motor that imparts vibration to the device. An intensity control means and a timer may also be located within the compartment. An upper section consists of a flexible, cushioning material on which a person's legs are rested when the device is used. In one embodiment of the invention, the lower face of the upper section abuts the upper face of the base section, and is adhesively secured thereto. The resultant body has one face sloping away from the top face at a sharp angle of about 45°.

In a preferred embodiment, a middle section consisting of front and back parts is provided between the upper and base sections. A channel extends laterally between the front and back middle sections and allows air to circulate therethrough, thus providing means for cooling the motor.

Preferably, each section is constructed of pre-cut foam of a selected density and deformability. Thus, the upper section is composed of softer, more flexible foam than that used in the middle and base sections. A balancing of structural and cushioning effects is thus achieved. The use of precut foam sections results in an inexpensive, easy to manufacture leg rest.

If desired, a removable protective skirt is provided that at least partially covers the polygonal body. Additionally, electric heating means, such as resistive heating elements, can be disposed within the upper section, thereby providing heat treatment capability. If desired, a carrying case can be used to store and transport the invention.

DETAILED DESCRIPTION

Figure 1:
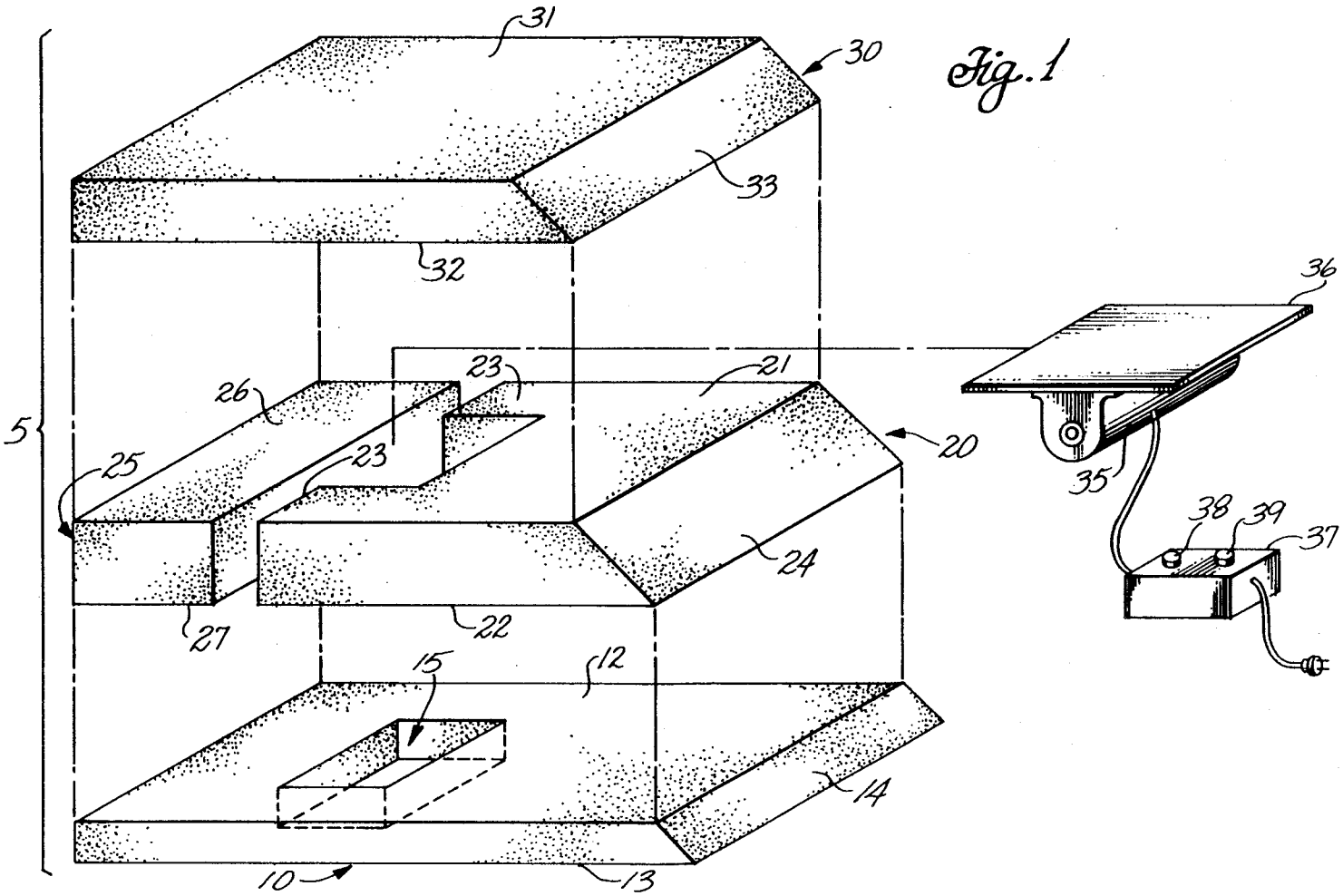
FIG. 1 is an exploded isometric view of a massaging leg rest made in practice of this invention.

A preferred massaging leg rest comprises an essentially polygonal body 5 of generally trapezoidal cross section, defined by three tiers or sections of resilient foam material.

The lowest tier comprises a generally trapezoidal base section 10 having generally parallel upper and lower faces 12 and 13 respectively, and an angular or sloping face 14 at the front end of the section. The base section 10 has a compartment 15 that extends from the upper face to the lower face through the section and provides access to a motor and control unit, as described below.

Atop the base section is a middle tier consisting of two parts. A generally U-shaped trapezoidal front middle section 20, having generally parallel upper and lower faces 21 and 22 respectively, legs 23, and an angular face 24, is positioned so that the lower face 22 of the front middle section abuts a front portion of the upper face 12 of the base section. A generally rectangular back middle section 25, having generally parallel upper and lower faces 26 and 27 respectively, is positioned so that the lower face 27 of the back middle section abuts a rear portion of the upper face 12 of the base section.

The front and back middle sections are separated from each other by a channel 28 extending laterally through the device. As is more fully described below, a motor 35 is positioned within the space 29 between the two legs 23 of the front middle section.

Atop the middle tier is a generally trapezoidal upper section 30, having generally parallel upper and lower faces 31 and 32, respectively, and a sloping face 33 at the same angle from the upper face as the sloping faces on the lower and middle sections. The lower face 32 of the upper section abuts the upper faces 21 and 26 respectively, of both the front and back middle sections.

A eccentric motor 35 or motor with an eccentric weight is mounted on a rigid board or plate 36, which is snugly placed between the upper section and the front and back middle sections parallel with the upper face of the leg rest. Therefore, the motor is located within the space 29 defined by the legs of the front middle section and the front face of the back middle section and may hang down into the opening 15 in the lower base section. Because the crosswise channel 28 through the body is open at both ends, air is free to circulate therethrough and cool the motor.

Connected to the motor is a control unit 37 comprising a timer 38 for setting the duration of massaging, and a massage intensity control 39 which controls motor speed. The control unit and electrical wiring may also be stored with the compartment 15 in the base section, and are easily accessible through the bottom opening.

The sectional parts are preferably made of lightweight polymeric foam of differing densities. The base section formed of the lower and middle pieces preferably comprises a sturdier, less resilient material than does the upper section. Accordingly, the requisite structural integrity is provided in the lower tiers of the leg rest, while desirable cushioning is provided in the upper tier.

The resiliency of each type of foam is stated in terms of load deflection as measured by Specification MIL-P-26514E, section 4.5.3.4.1. In a preferred embodiment the upper section has a load deflection of from about 34 to about 38, while the middle and base sections each have a load deflection of from about 65 to about 70.

The three tiers comprising the leg rest are vertically stacked atop each other and secured together by adhesive means such as glue. This also secures the motor mounting board 36 in place between the middle and upper sections. The result is a generally polygonal body of generally trapezoidal cross section. A thigh support is defined by the sloping face comprised of the three angular faces of the base, front middle and upper sections (14, 24 and 33 respectively).

The angle between the sloping front face of the body and its top is sharp instead of rounded as occurs when a mattress is bent on an adjustable bed. The sloping face is at an angle of about 45° relative to the top surface of the leg rest. This forms a very comfortable support for the calves and thighs as a person lies prone. The vibrations of the body of foam are also transmitted readily to the legs to provide a soothing massage.

Figure 2:
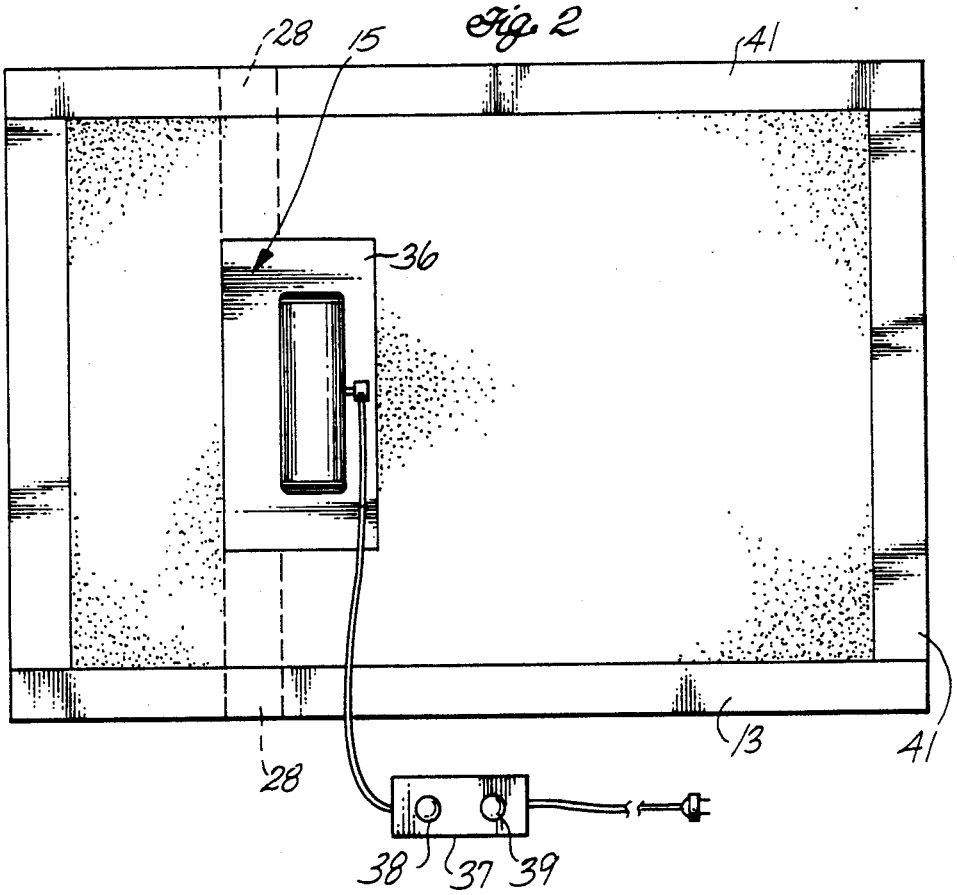
FIG. 2 is a bottom view of the leg rest.
Figure 3:
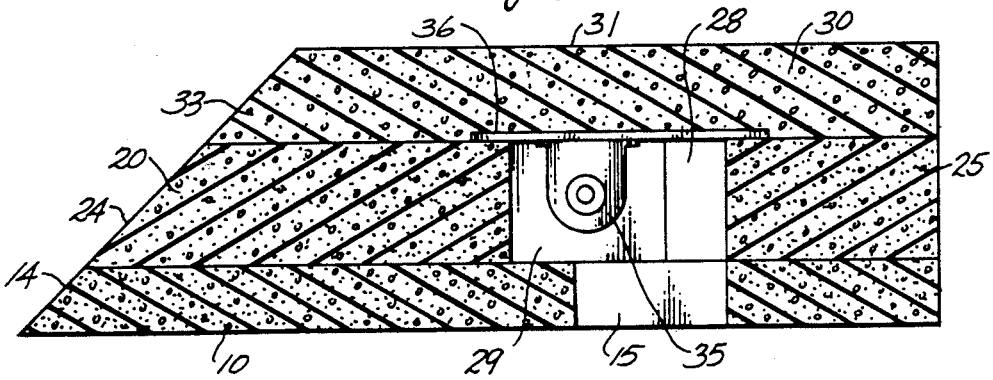
FIG. 3 is a longitudinal cross section taken along line 3—3 of FIG. 2.

The leg rest is preferably provided with a protective skirt 41 that at least partially covers each of the sections, and which may be removed for cleaning. The skirt is preferably a tailored sheet of fabric that fits against the top, side, front and back faces of the foam body and has edge portions that fold down around the edges of the bottom face of the leg rest as seen in FIG. 2. The corners of the skirt are provided with strips of Velcro hook and pile connector tape for secure connections and easy removal. Grippers, buttons, zippers or other means may be used for securing the skirt on the foam body of the leg rest.

If desired, the upper section may also comprise heating means (not shown), such as electrical resistive heating elements, for elevating the temperature of the upper section and providing warmth to a person's legs.

In operation, the invention is used as follows. The leg rest 5 is placed on a bed or other generally horizontal surface and the motor is switched on. The timer is set and the massaging intensity control is adjusted to a desired level. A person lies prone on the bed or other surface, placing his legs on the upper surface 31 of the leg rest's upper section, and his thighs on the sloping thigh support. The sharp 45° angle between the upper face and the sloping face permit good contact between the thighs and sloping face for support and massaging. A relaxing, therapeutic sensation is felt directly on the person's calves, ankles, and thighs.

The massaging leg rest described above provides relief from edema, circulatory problems, lower back discomfort, and muscular fatigue and discomfort, and discomfort associated with varicose veins. Pregnant women find it of great benefit.

The leg rest is conveniently manufactured, inexpensive, and completely portable. A fabric carrying case with zipper and handle can be used for enclosing and carrying the massaging leg rest, much like a suitcase.

In an exemplary embodiment of such a portable massaging leg rest, the height is about 9 inches, the width is about 21 inches and the length of the top is about 21 inches. The base is about 30 inches long. The two lower pieces of foam have a total thickness of about six inches, leaving about three inches of the softer foam on top. The cross channel for cooling flow of air compartment in the middle layer of foam is ten inches by seven inches and the opening through the lower layer is ten inches by five inches. This provides ample space for the motor and control unit.

From the foregoing description, it is apparent that many variations and modifications of the above-described structures may be practiced without meaningfully departing from the scope of the invention. For example, the top and sloping faces could be somewhat contoured for cushioning the legs, but by having resilient materials of construction, this added cost is not justified.

Other inexpensive means for providing massaging action may be used such as an electrical oscillating motor. Accordingly, the foregoing description should not be read as pertaining only to the precise structures described, but rather should be read consistent with and as support for the following claims for the fullest and fairest scope.

I claim:

1. A portable massaging leg rest comprising:

a resilient, polygonal, generally trapezoidal body having a horizontal top face sufficiently large for supporting a prone person's calves approximately horizontal and a sloping front face sufficiently large for supporting a prone person's thighs at an angle of about 45°;

means for vibrating at least the upper portion of the body for massaging a person's legs; and means for housing the vibrating means within the body.

2. A massaging leg rest as claimed in claim 1 wherein the leg supporting body comprises at least an upper layer of foam material.

3. A massaging leg rest as claimed in claim 1 wherein the vibrating means comprises an eccentric motor mounted on a rigid plate mounted between pieces of resilient material forming the body.

4. A massaging leg rest as claimed in claim 3 comprising a channel extending at least part of the way from an outside surface through the body to the motor through which air can circulate for cooling the motor.

5. A massaging leg rest as claimed in claim 1 further comprising a protective skirt which at least partially covers the polygonal body.

6. A massaging leg rest as claimed in claim 5 wherein the skirt is removable.

7. A massaging leg rest as claimed in claim 1 comprising a sharp angle of about 45° between the sloping front face of the body and the upper face of the body.

8. A portable massaging leg rest comprising:

a generally polygonal body having a top face sufficiently large for supporting a prone person's calves and a front face sloping away from the top face with a sharp angle of about 45° between the top and sloping faces, the front face being sufficiently large for supporting a prone person's thighs at an angle of about 45° while positioning the person's calves horizontally above the person's torso, with at least an upper portion of the body being formed of a cushioning resilient material; and means mounted within the body for causing massaging motion in at least the top portion of the body.

9. A leg rest as recited in claim 8 wherein the stiffness of the upper portion of the body is less than the stiffness of the lower portion of the body.

10. A leg rest as recited in claim 9 wherein the body is formed of resilient foam and the means for causing massaging motion comprises a rigid plate in the foam below the top face of the body and means mounted on the plate for vibrating the plate.

11. A leg rest as claimed in claim 10 comprising a channel extending at least part of the way from an outside surface through the body to the motor through which air can circulate for cooling the motor.

12. A leg rest as claimed in claim 8 further comprising timing and control means connected to the means for causing massaging motion for controlling the duration and intensity of massaging.

13. A portable massaging leg rest comprising:

a generally trapezoidal base section having generally parallel upper and lower faces and a compartment within the base section;

a generally trapezoidal upper section of resilient foam having generally parallel upper and lower faces, the lower face being in abutting relation to the upper face of the base section, the base section and upper section together defining a polygonal body of generally trapezoidal cross section on which a person's calves may be rested horizontally at an elevation above the person's torso and a sloping front surface on which a prone person's thighs may be rested while the person's calves are elevated; and a plate having an eccentric motor mounted thereon for vibrating the upper section, located between sections of the resilient foam making up the body such that the motor is positioned within the compartment.

14. A massaging leg rest as claimed in claim 13 further comprising timing and control means connected to the motor and removably placed in the compartment for controlling the duration and intensity of massaging.

15. A massaging leg rest as claimed in claim 13 wherein the upper section has a load deflection as measured by Specification MIl-P-26514E, section 4.5.3.4.1 of from 34 to 38, and the base section has a load deflection of from 65 to 70.

16. A massaging leg rest as claimed in claim 13 comprising a channel extending at least part of the way from an outside surface through the body to the motor through which air can circulate for cooling the motor.

17. A massaging leg rest as claimed in claim 13 wherein the upper section is more compressible than the base section.

18. A massaging leg rest as claimed in claim 13 further comprising a removable protective skirt which at least partially covers the polygonal body.

19. A massaging leg rest as claimed in claim 16 wherein the plate is mounted between the lower face of the upper section and the upper face of the base section.

20. A portable massaging leg rest comprising:

a polygonal, generally trapezoidal body of resilient foam having a horizontal top face sufficiently large for supporting a prone person's calves horizontally and a sloping front face for elevating the prone person's calves above the person's torso;

an eccentric motor mounted on a rigid plate mounted between pieces of resilient foam forming the body for vibrating at least the upper portion of the body for massaging a person's legs; and a channel extending at least part of the way from an outside surface through the body to the motor through which air can circulate for the cooling of the motor.

21. A massaging leg rest as claimed in claim 20 wherein the upper portion of the foam body is more compressible than the lower portion of the foam body.

22. A massage leg rest as claimed in claim 21 wherein the upper portion has a load deflection as measured by Specification MIL-P-26514E, section 4.5.3.4.1 of from 34 to 38, and the lower portion has a load deflection of from 65 to 70.

23. A massaging leg rest as claimed in claim 20 further comprising a removable protective skirt which at least partially covers the polygonal body.

* * * * *